US008656517B2

(12) United States Patent
Takahashi

(10) Patent No.: US 8,656,517 B2
(45) Date of Patent: Feb. 25, 2014

(54) JAPANESE DRESS

(76) Inventor: Kenichi Takahashi, Oita (JP)

( * ) Notice: Subject to any disclaimer, the term of this patent is extended or adjusted under 35 U.S.C. 154(b) by 26 days.

(21) Appl. No.: 13/325,967

(22) Filed: Dec. 14, 2011

(65) Prior Publication Data

US 2012/0159693 A1 Jun. 28, 2012

(30) Foreign Application Priority Data

Dec. 28, 2010 (JP) ..... 2010-293087

(51) Int. Cl.
*A41D 13/00* (2006.01)

(52) U.S. Cl.
USPC ..... 2/114

(58) Field of Classification Search
USPC ..... 2/114, 51, 52, 169, 84, 74, 76
See application file for complete search history.

(56) References Cited

U.S. PATENT DOCUMENTS 818,351 A * 4/1906 Clark ..... 2/114
2,260,168 A * 10/1941 Costanza ..... 2/76
3,144,661 A * 8/1964 Buser ..... 2/114
3,803,640 A * 4/1974 Ericson ..... 2/114
4,106,120 A * 8/1978 Zurbrigg et al. ..... 2/51
4,535,481 A * 8/1985 Ruth-Larson et al. ..... 2/114
4,570,268 A * 2/1986 Freeman ..... 2/114
4,622,699 A * 11/1986 Spriggs ..... 2/114
5,050,243 A * 9/1991 Udell ..... 2/114
5,228,141 A * 7/1993 Remsky et al. ..... 2/114
6,012,166 A * 1/2000 Burbidge ..... 2/83
6,115,839 A * 9/2000 Covington et al. ..... 2/69
6,378,136 B2 * 4/2002 Matsushita ..... 2/114
6,484,321 B1 * 11/2002 Shamam ..... 2/114
6,694,521 B1 * 2/2004 Hopkins ..... 2/83

* cited by examiner

*Primary Examiner* — Richale Quinn
(74) *Attorney, Agent, or Firm* — Manabu Kanesaka

(57) ABSTRACT

A full-length Japanese dress that can be easily worn by anybody, does not come loose, and is excellent in design is provided. A full-length Japanese dress 11 in which an upper body 12 and a lower body 32 that are cut based on each curve information taken from measurements of a wearer are integrated at a position of a waist line W includes a first string 42 to a sixth string 47 that are separately fixed to predetermined positions, wherein the third string 44 and the fourth string 45 are tied together to raise a lower front, the fifth string 46 and the sixth string 47 are tied together to further raise a lower front left bottom, and the first string 42 and the second string 43 are tied together to raise an upper front right bottom, whereby the Japanese dress can be worn with a finish of a portion around a bottom made beautiful.

14 Claims, 8 Drawing Sheets

JAPANESE DRESS

CROSS-REFERENCE TO RELATED APPLICATION

The present application is based on, and claims priority from, Japanese Application Serial Number JP2010-293087, filed Dec. 28, 2010, the disclosure of which is hereby incorporated by reference herein in its entirety.

TECHNICAL FIELD

The present invention relates to an art relating to a full-length Japanese dress without an overlap portion for adjusting a length of the Japanese dress that is one of the causes of the Japanese dress coming loose.

BACKGROUND ART

Japanese dresses that are conventionally worn generally have neckbands each with a large width of, for example, about 5.5 cm. The neckbands of the Japanese dresses in this case are high and linearly sewn. Therefore, when a body is fitted to the dress, correction of a bodily shape is generally performed by winding a towel around a waist to make a bodily shape without a waist on purpose.

Further, a Japanese dress has an overlap, and therefore, the overlap gives an impression of being thick around the belly when a wearer wears the Japanese dress. Accordingly, in order to keep an entire figure in balance, the wearer makes her head look large by putting the wearer's hair up and adding a hair filler or the like to the hair to give the hair more volume.

This kind of problem accompanying dressing can be solved by the wearer having her hair done in a beauty salon or the like, and being dressed by a fitter, but working time for hair and dressing is required, and a cost is also required.

Thus, as shown in, for example, Japanese Patent Application Publication No. 2003-336107, an attempt is made to solve the problems concerning the overlaps of Japanese dresses.

However, Japanese Patent Application Publication No. 2003-336107 can facilitate formation of an overlap that is said to be difficult in dressing, but does not eliminate the overlap itself.

Thus, Japanese Patent Application Publication No. 2006-2270 proposes a Japanese dress from which an overlap is eliminated.

Japanese Patent Application Publication No. 2006-2270 proposes an easily worn Japanese dress in which upper and lower front waist cords are attached to the main body of the Japanese dress, cord-passing holes are further provided in right and left side portions, the upper and lower front waist cords are passed through the cord-passing holes and are wound around the waist portion of a wearer to be tied. Further, a neckband of the main body of the above described Japanese dress is attached by being widening in the downward direction, and a neckpiece is detachably attached to the upper edge portion of the neckband, whereby the above described Japanese dress can be worn by a wearer alone. Further, the shape of the neckband can be formed to be the same shape as the shape that is formed when the wearer wears a Japanese dress with a wide neckband. Furthermore, the neckpiece is attached to the neckband to give a feel of a long undergarment, whereby the same wearing figure as the wearing figure of the wearer wearing an ordinary Japanese dress can be made.

However, in Japanese Patent Application Publication No. 2006-2270, the width of the neckband is so large that even if an accessory is put around a neck when the Japanese dress is worn, the accessory is hidden by the neckband to be invisible. In addition, depending on the person, there arises the disadvantage that the neck itself is hidden by the neckband. Further, the above described Japanese dress is fixed by the waist cords being wound around a body, and therefore, there arises the disadvantage that the wearer is not released from a sense of tightness due to tightening at the time of wearing the Japanese dress.

Thus, in order to solve the above described problems concerning wearing of a Japanese dress with the determination to move beyond the status quo that a great majority of Japanese cannot wear on their own Japanese dresses, which should be called native dresses for themselves and to restore the tradition, the present inventors have made efforts to develop a full-length Japanese dress which everybody can casually wear, and which can give a pleasure of enjoying personal adornment around a neck as if the neckband were a V neck of a Western-style dress with the design thereof arranged to suit contemporary taste by eliminating a neckband with a large width.

More specifically, an object of the present invention is to provide a full-length Japanese dress with excellent design that can be easily worn by anybody and does not come loose.

SUMMARY OF THE INVENTION

The present invention is made to achieve the above described object. More specifically, a full-length Japanese dress in which an upper body and a lower body that are cut based on each curve information taken from measurements of respective parts of a body including a bust, an underbust, a waist and hips of the wearer are integrated by being three-dimensionally sewn up together at a position of a waist line without interposition of an overlap, includes at least a first string to a sixth string, wherein the first string has one end portion thereof fixed to an upper side of the waist line of a lower front right side, which is located inside from a right side sewing line, the second string has one end portion thereof fixed to a lower side of the waist line of an upper front reverse side, which is located inside from a left side sewing line, the third string has one end portion thereof fixed to a lower side of the waist line of a lower front reverse side, which is located inside from a right side open end, the fourth string has one end portion thereof fixed to an upper side of the waist line, which is located inside from an extension line of the left side sewing line, the fifth string has one end thereof fixed to a region which is located inside from the right side open end and is located 11 cm to 13 cm above an intermediate position in a direction of a vertical length of the lower body, and the sixth string has one end portion thereof fixed to a region which is along an outside of the left side sewing line and is located 16 cm to 18 cm above the intermediate position in the direction of the vertical length of the lower body, and when worn, the third string and the fourth string are tied together to raise a lower front, the fifth string and the sixth string are tied together to further raise a lower front left bottom, and the first string and the second string are tied together to raise an upper front right bottom, whereby a finish of a portion around a bottom is made beautiful.

According to the above, an overlap can be eliminated, and therefore, the wearer can eliminate the disadvantages caused by the overlap such as winding strings around a waist that is accompanied by tightness and painfulness as well as the dress coining loose at the time of wearing.

Further, the wearer can make the finish of the portion around the bottom beautiful by slightly raising the bottom edge when wearing the dress by tying the strings at the respective corresponding positions together with respect to the first string to the sixth string.

In addition, the fifth string and the sixth string are located at the portion above the knees of the wearer when these strings are tied together, whereby the wearer is allowed to walk with relatively long steps, and therefore, the wearer can walk comfortably and breezily with the steps corresponding to the modern way of living.

As a more preferable mode, in the upper body, a curve line around a neck, and a curve line extending from the waist position to a sleeve side are formed, and in the lower body, a curve line that makes the lower body gradually narrower from the waist position toward the bottom is formed.

According to the above, the curve of the lower body is given to make the lower body gradually narrower from the waist position toward the bottom, and therefore, the wearer can enjoy western-style fashion with the finish of the portion around the bottom made beautiful.

As still another mode, the upper body has no sleeve. Further, the upper body includes short sleeves. Furthermore, the upper body includes long sleeves.

According to the above, the upper body is formed to have no sleeve, and therefore, the wearer can enjoy personal adornment around the neck by having various accessories on the neck with an impression as if the color were similar to a V neck of a western-style dress. Further, the wearer wears the Japanese dress by using a narrow sash, and matches high-heeled shoes, mules or boots with the dress as footwear, whereby the wearer can exhibit beauty without a sense of incompatibility at a party in a foreign country with the impression of a western-style dress.

Further, the upper body is formed to be provided with the short sleeves, and therefore, the wearer can wear the dress easily without minding the sleeves even when having a meal, and holding and taking care of a child.

Furthermore, the upper body is formed with the long sleeves, and therefore, the dress looks similar to the conventional Japanese dress, whereby the wearer can wear the dress with elegance in formal ceremonies such as a wedding ceremony and an entrance and graduation ceremonies.

Further, out of the upper body and the lower body that are formed as an unlined dress without a lining cloth, the upper body is equipped with the short sleeves and the narrow neckband.

According to the above, out of the upper body and the lower body that are formed as an unlined dress without a lining cloth, the upper body includes the short sleeves and the narrow neckband, and therefore, the wearer can easily move without interference of the sleeves at the time of wearing the dress. In addition, even though the neckband is attached to the dress, the neckband is narrow, and therefore, the portion around the neck can be made neat. Furthermore, a sense of stiffness given by the conventional wide neckband is eliminated and excellent balance is given. As a result, the Japanese dress can be worn casually at home as an everyday dress.

In this case, the curves of the upper body are preferably applied to the line of the portion around the neck and the line extending from the waist position to the side sleeve, and the curve of the lower body is preferably applied to make the lower body gradually narrower from the waist position toward the bottom. Further, the upper body may be provided with no sleeve, with short sleeves or with long sleeves. Further, the upper body and the lower body may be formed to be an unlined dress without a lining cloth, and the upper body may be equipped with short sleeves and a narrow neckband.

DETAILED DESCRIPTION

Figure 1:
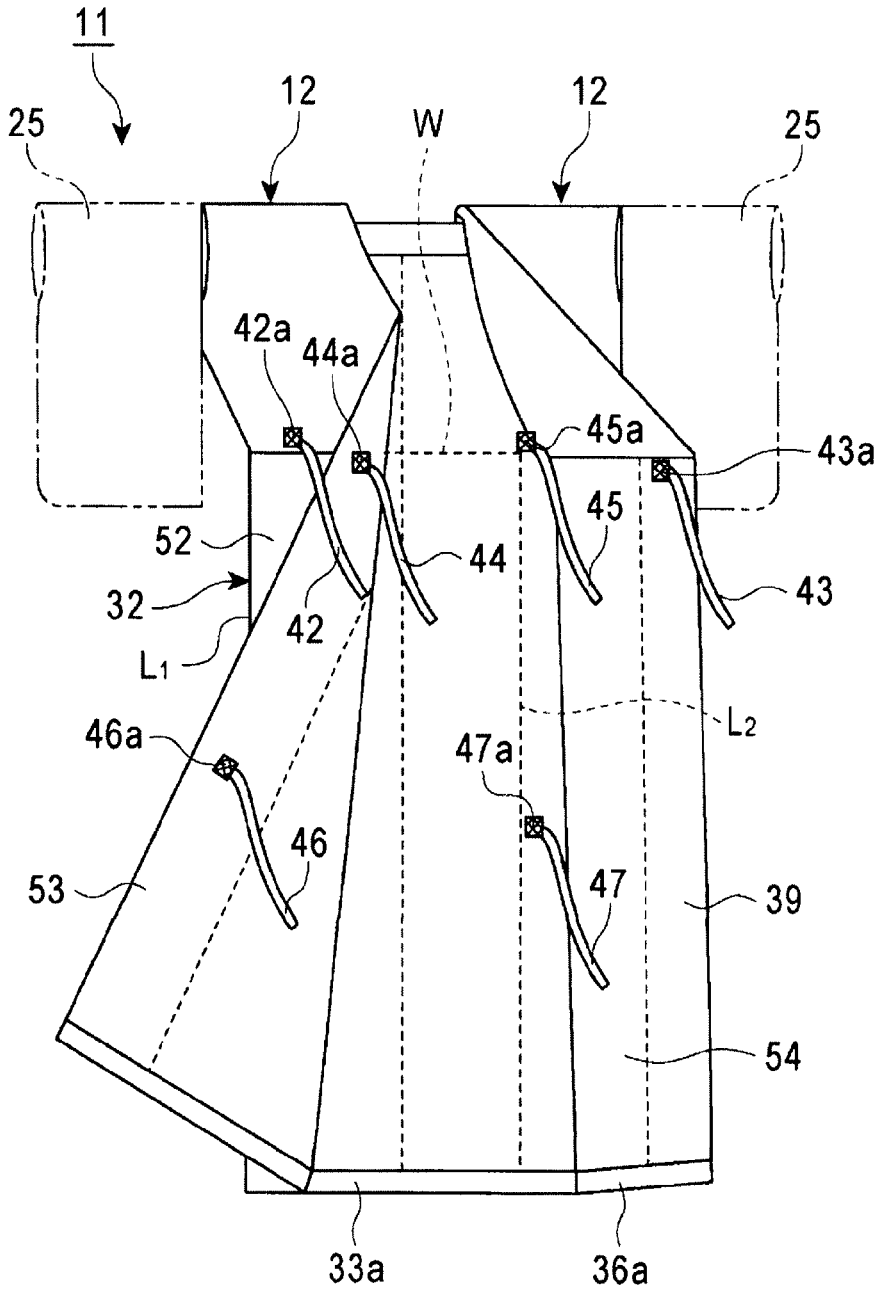
FIG. 1 is a front view showing one example of the present invention.

A whole of a full-length Japanese dress 11 according to the present invention includes an upper body 12 and a lower body 32 that are cut based on each curve information taken from measurements of respective parts of a body including a bust, an underbust, a waist and hips. As shown in FIG. 1, the upper body 12 and the lower body 32 are three-dimensionally sewn up together at a position of a waist line W without interposition of an overlap.

In this case, for the upper body 12 and the lower body 32, for example, a high-quality polyester material is preferably used. That is, the upper body 12 and the lower body 32 are preferably formed by using a material that is wrinkle-resistant, is not eaten by moths, does not stain easily, can be washed at home and is easily stored.

Figure 2A:
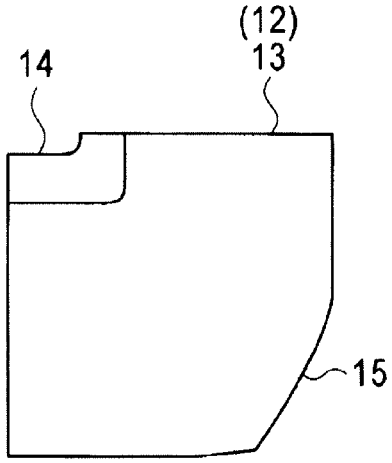
FIG. 2A is an explanatory view showing an upper back section of an upper body in one example of the present invention.
Figure 2B:
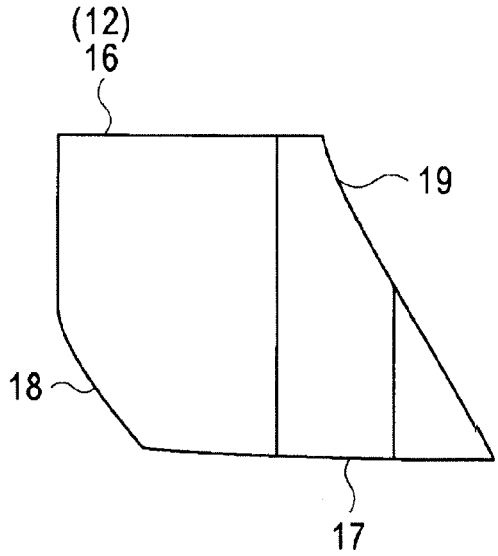
FIG. 2B is an explanatory view showing an upper front section of the upper body in one example of the present invention.
Figure 8A:
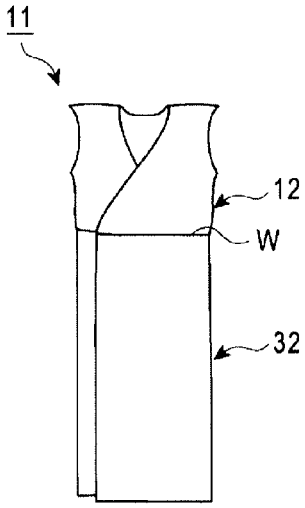
FIGS. 8A to 8D are explanatory views showing image examples in a wearing state of the present invention by dividing the image examples according to circumstances.
Figure 8B:
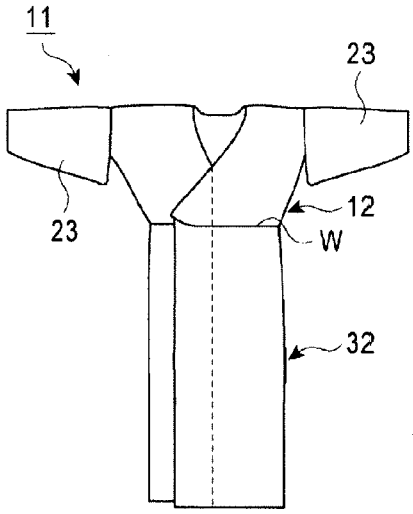
Figure 8C:
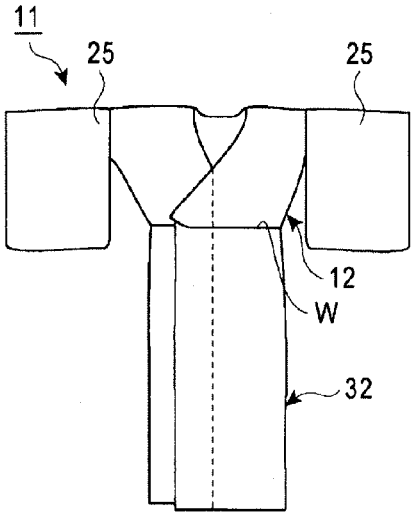

Further, the upper body 12 in the present invention comes in four types that are a type with no sleeve that is a first example shown in FIGS. 2A, 2B, and 8A (the solid line portion of the upper body 12 in FIG. 1), a type with short sleeves that is a second example shown in FIGS. 4 and 8B, a type with long sleeves that is a third example shown in FIGS. 5 and 8C (the dashed line portion of the upper body 12 in FIG.

Figure 8D:
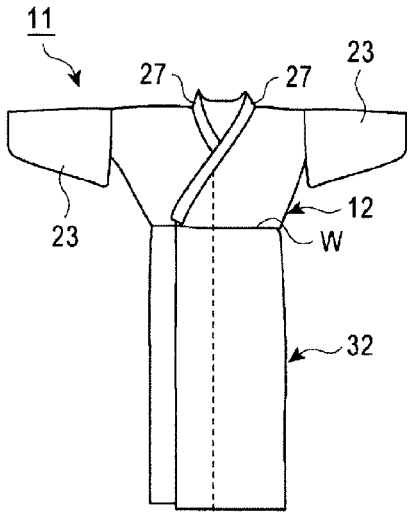

1), and a type with a narrow neckband and short sleeves formed as an unlined dress without a lining cloth that is a modified example of the second example, and is shown in FIGS. 4 and 8D. The lower body 22 shown in FIG. 3 is commonly combined with any of the above described types of upper bodies 12, whereby the Japanese dress 11 of the length of a wearer's body according to the present invention is formed.

Here, describing the upper body 12 of the type with no sleeve that is the first example in more detail, the upper back section 13 shown in FIG. 2A includes a bending portion 14 formed at a region where a back portion of the neck of a wearer is located, and a sleeve side curve portion 15 that is formed at a region extending to a sleeve side from the waist position.

Further, an upper front section 16 shown in FIG. 2B includes a waist side curve portion 17 that is formed at the waist position, a sleeve side curve portion 18 that is formed at a region extending from the waist position to a sleeve side, and a curved portion 19 around the neckband that is formed around the neckband.

Figure 3A:
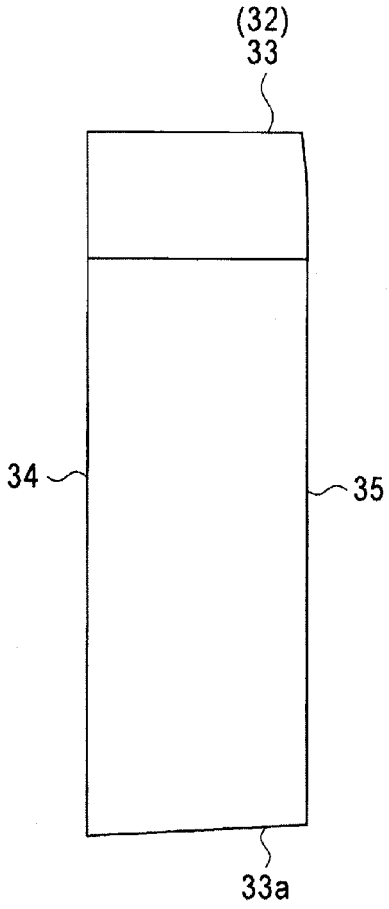
FIG. 3A is an explanatory view showing a lower back section of a lower body in one example of the present invention.
Figure 3B:
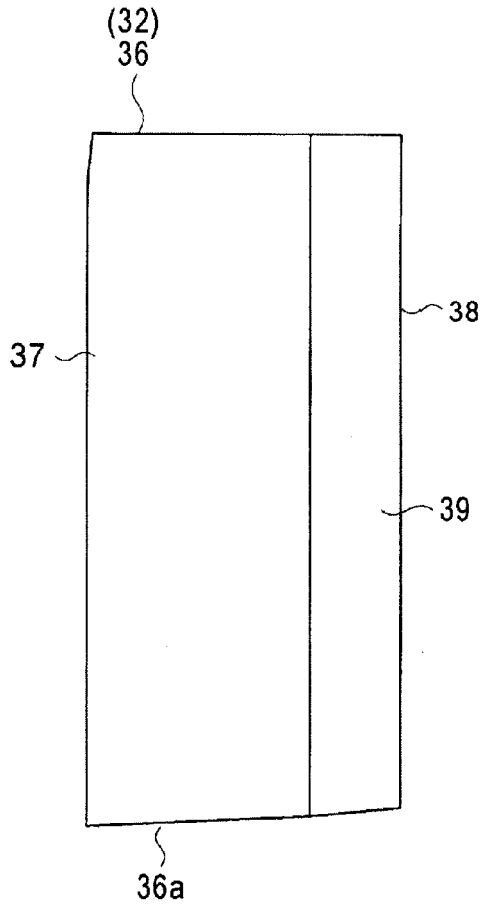
FIG. 3B is an explanatory view showing a lower front section of the lower body in one example of the present invention.

FIGS. 3A and 3B are explanatory views showing the lower body 32 shown in FIG. 1 in a state in which the lower body 32 is separated from the upper body 12. FIG. 3A shows a lower back section 33. FIG. 3B shows a lower front section 36. As shown in FIG. 3A, the lower back section 33 has a proper plane size, for example, a vertical width of about 98 cm and a lateral width of 27 cm. One side edge 34 that is located at a left side is a straight line in FIG. 3A. The other side edge 35 that is located at a right side is formed to be a nonlinear line in which a waist region located inside by about 1 cm and a region below a knee located inside by about 1 cm at a position of a bottom 33*a*.

The lower front section 36 has one side edge 37 located at a left side of a gusset 39 as shown in FIG. 3B. The one side edge 37 is a nonlinear line in which a waist region is located inside by about 1 cm, and a region below a knee is located inside by about 1 cm at a position of a bottom 36*a*. The other side edge 38 is located at a right side and is formed to be a straight line. Therefore, the lower body 32 is formed into a state in which the lower body 32 is slightly constricted at the waist position and becomes gradually narrower at the bottoms 33*a* and 36*a* sides.

Figure 4A:
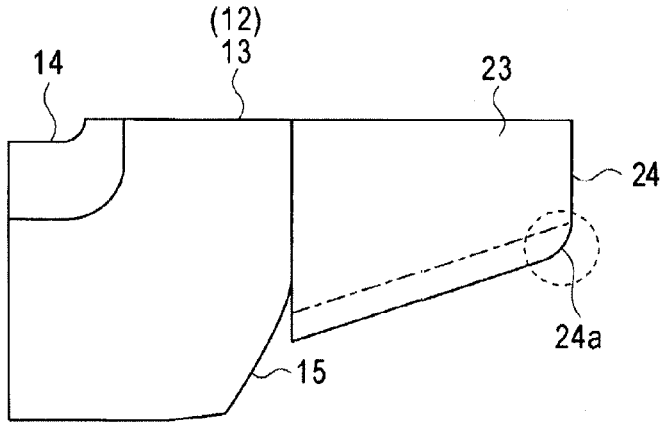
FIG. 4A is an explanatory view showing an upper back section of an upper body in another example of the present invention.

The upper body 12 of the type with short sleeves that is the second example will be described in detail. As shown in FIG. 4A, the upper back section 13 includes the bending portion 14 that is formed at the region where a back portion of a neck of a wearer is located, and the sleeve side curve portion 15 that is formed at the region extending from the waist position to the sleeve side, and has the form similar to that of the upper body 12 shown in FIG. 2A except for a short sleeve 23.

Figure 4B:
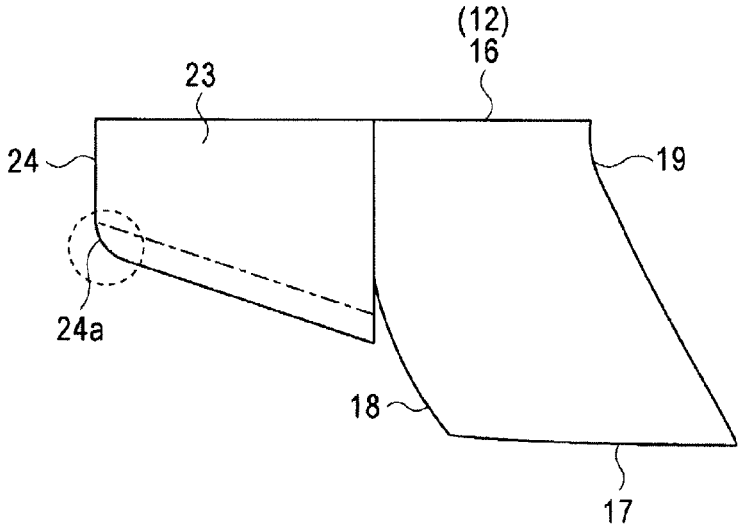
FIG. 4B is an explanatory view showing an upper front section of the upper body in the other example of the present invention.

The upper front section 16 shown in FIG. 4B includes the waist side curve portion 17 formed at the waist position, the sleeve side curve portion 18 formed at the region extending from the waist position to the sleeve side, and the curve portion 19 around a neckband that is formed around the neckband, and has a form similar to that of the upper body 12 shown in FIG. 2B except for the short sleeve 23.

Figure 4C:
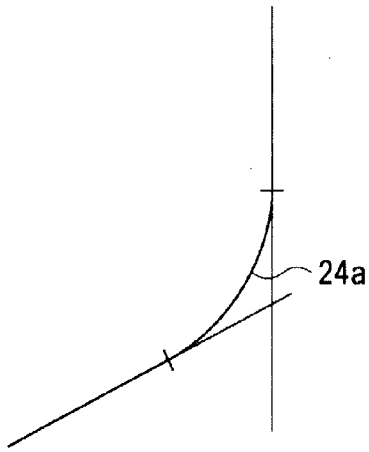
FIG. 4C is an explanatory view showing roundness that is given to a lower end edge of a sleeve edge of a short sleeve.

As partly shown by the dashed lines of the straight lines in FIGS. 4A and 4B, the short sleeve 23 is formed as a conventional functional straight sleeve that allows an arm to move easily. Further, as shown by the solid lines, the sleeve width can be made slightly larger than that of the straight sleeve, the sleeve edge can be sewn a little from the lower side and the sleeve edge can be made narrow. According to this, the sleeves can be formed to be close to the images of the conventional sleeves. In this case, with respect to the short sleeve 23 of the type which is formed to be close to the image of the conventional sleeve, roundness of a lower end edge 24*a* of a sleeve edge 24 (regions surrounded by the circular broken lines in FIGS. 4A and 4B) is preferably formed as shown in FIG. 4C, for example. According to this, casualness, softness and an atmosphere of an everyday wear can be created at the time of wearing the Japanese dress of this type.

Figure 5A:
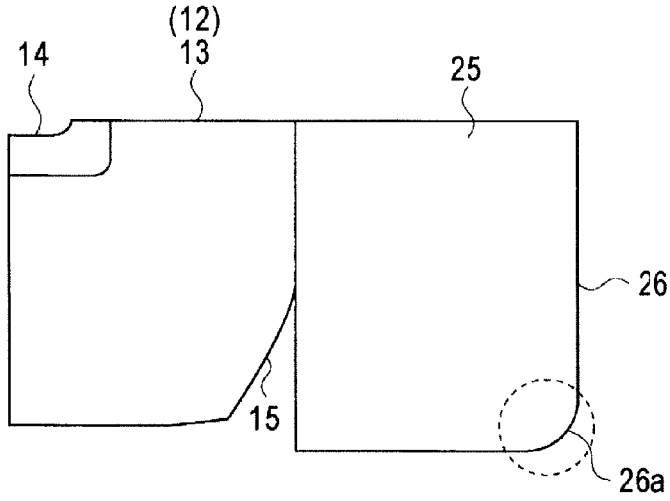
FIG. 5A is an explanatory view showing a modified example of the upper back section of the upper body in the present invention.

Next, the upper body 12 of the type with long sleeves that is the third example will be described in detail. As shown in FIG. 5A, the upper back section 13 includes the bending portion 14 that is formed at the region where the back portion of the neck of the wearer is located, and the sleeve side curve portion 15 that is formed at the region that extends from the waist position to the sleeve side, and has a form similar to that of the upper body 12 shown in FIG. 2A except for a long sleeve 25.

Figure 5B:
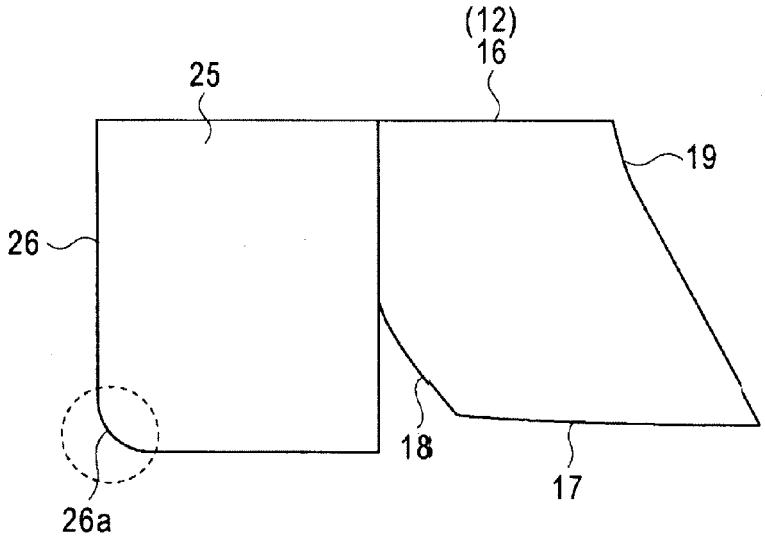
FIG. 5B is an explanatory view showing a modified example of the upper front section of the upper body in the present invention.
Figure 5C:
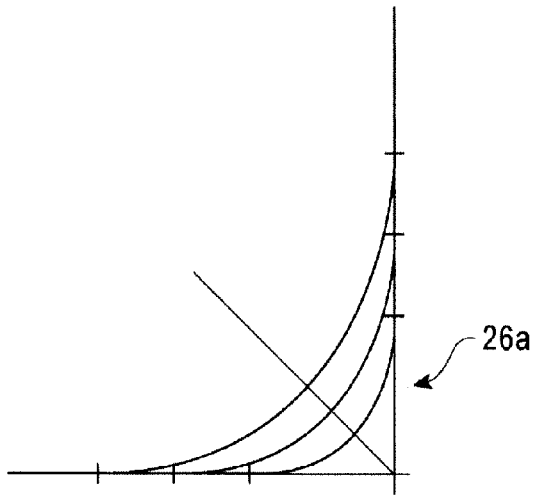
FIG. 5C is an explanatory view showing roundness that is given to a lower end edge of a sleeve edge of a short sleeve.

As shown in FIG. 5B, the upper front section 16 includes the waist side curve portion 17 that is formed at the waist position, the sleeve side curve portion 18 that is formed at the region that extends from the waist position to the sleeve side, and the curve portion 19 around the neckband that is formed around the neckband, and has a form similar to that of the upper body 12 shown in FIG. 2B except for the long sleeve 25.

The long sleeve 25 is formed as the sleeve close to the shape of the sleeve included by a conventional Japanese dress. In this example, in the long sleeve 25, roundness of a lower end edge 26*a* at a sleeve edge 26 (region surrounded by the circular broken line) side can be properly changed as three patterns shown in FIG. 5C in accordance with the ages of wearers.

Further, the upper body 12 that is the second example is of a type with a narrow neckband and short sleeves that is formed as an unlined dress without a lining cloth that is a modified example of the type with short sleeves, and is formed as shown in FIG. 8D by including the short sleeves 23 shown as the solid lines in FIGS. 4A and 4B. The difference from the second example in the modified example is that the modified example includes a narrow neckband 27 besides being formed as an unlined dress without a lining cloth as a whole.

More specifically, as the neckband 27 shown in FIG. 8D, the neckband formed to have a narrow width of about 4 cm is fixed by sewing, and the neckband 27 differs from the neckband of the conventional Japanese dress that has a large width of about 5.5 cm. Thereby, the portion around the neck is made neat, and a sense of stiffness can be eliminated.

The Japanese dress 11 of the length of a wearer's body is formed by the upper body 12 and the lower body 32 with the above described constitutions being integrated by being three-dimensionally sewn up together in the position of a waist line W. The Japanese dress 11 of the length of a wearer's body is formed by further including a first string 42 to a sixth string 47 as shown in FIG. 1 and FIGS. 6A to 6C.

Figure 6A:
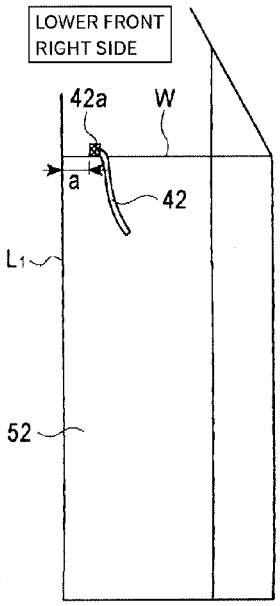
FIGS. 6A to 6C are explanatory views showing a disposition relationship of a first string to a sixth string in the present invention.

The first string 42 has one end portion 42*a* thereof fixed to an upper side of the waist line W of a lower front right side 52 located at a position inside by a length a (for example, 5 cm) from a right side sewing line L1 as shown in FIG. 6A by sewing or the like.

Figure 6B:
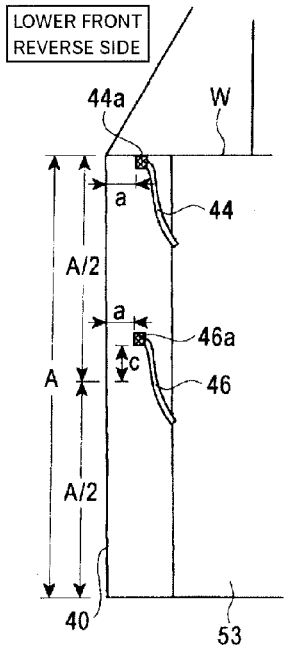
Figure 6C:
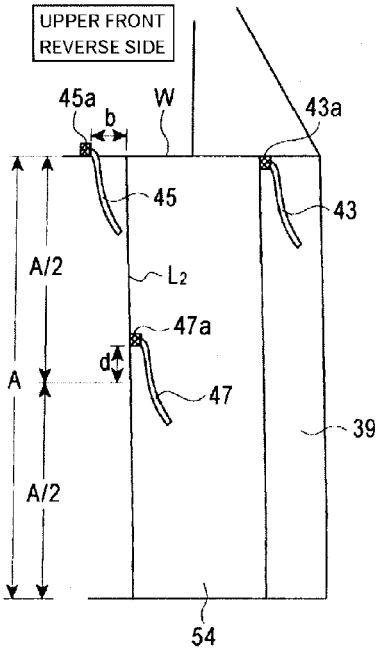

The second string 43 has one end portion 43*a* thereof fixed to a lower side of the waist line W of an upper front reverse side 54, which is located at a position inside by a length corresponding to a width of the gusset 39 as shown in FIG. 6C by sewing or the like.

The third string 44 has one end portion 44*a* thereof fixed to a lower side of the waist line W of a lower front reverse side 53, which is located inside by the length a (for example, 5 cm) from a right side open end 40 as shown in FIG. 6B by sewing or the like.

The fourth string 45 has one end portion 45*a* thereof fixed to an upper side of the waist line W, which is located inside by a length b (for example, 3 cm) from a left side sewing line L2 as shown in FIG. 6C by sewing or the like.

The fifth string 46 has one end portion 46*a* thereof fixed to a region that is located inside by the length a (for example, 5 cm) from the right side open end 40 and is located at an upper side by a length c (11 to 13 cm, more preferably 12 cm) from an intermediate position A/2 in a direction of a vertical length A of the lower body 32 as shown in FIG. 6B by sewing or the like.

The sixth string 47 has one end portion 47*a* thereof fixed to a region that is along an outside of the left side sewing line L2 and is located at an upper side by a length d (16 to 18 cm, more preferably 17 cm) from the intermediate position A/2 in the direction of the vertical length A of the lower body 32 as shown in FIG. 6C by sewing or the like.

According to the present invention, the overlap can be eliminated as shown in FIG. 1, and therefore, the wearer can eliminate the disadvantage caused by the overlap that is winding of strings accompanied by tightness and painfulness in addition to coming loose at the time of wearing.

Figure 7A:
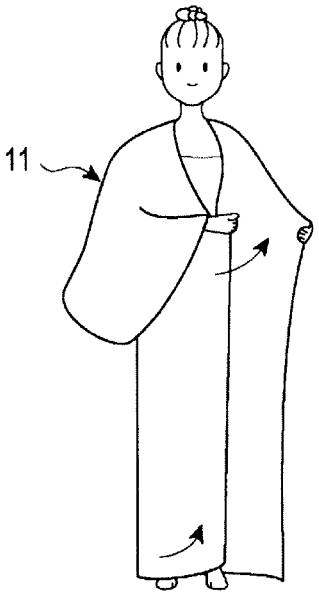
FIGS. 7A to 7C are explanatory views illustrating a wearing process of the present invention.
Figure 7B:
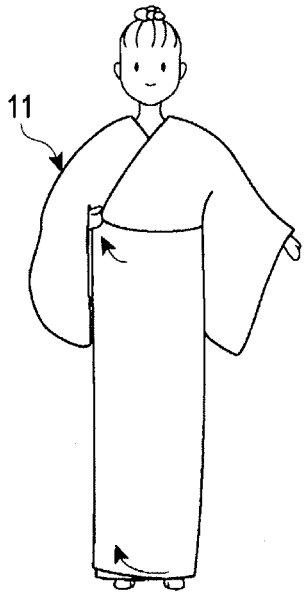
Figure 7C:
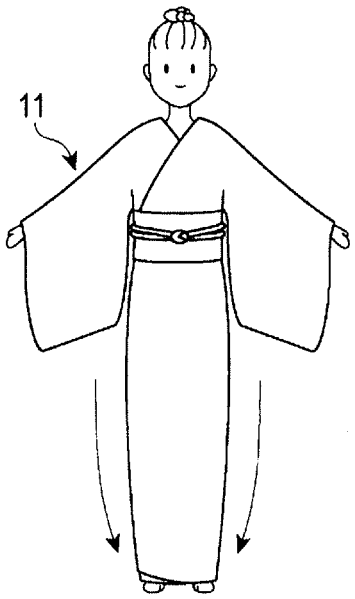

Further, at the time of wearing the Japanese dress, the third string 44 and the fourth string 45 are tied together to raise the lower front as shown in FIG. 7A, the fifth string 46 and the sixth string 47 are tied together to raise the lower front left bottom further upward, and the first string 42 and the second string 43 are tied together to raise the upper front right bottom as shown in FIG. 7B, whereby the Japanese dress can be worn with the finish of the lower portion around the bottom made beautiful by fastening a sash as shown in FIG. 7C.

In addition, the fifth string 46 and the sixth string 47 are located at the portion above the knees of the wearer when these strings are tied together, as a result of which, the wearer is allowed to walk with relatively long steps, whereby the wearer can walk comfortably and breezily with the steps corresponding to the modern way of living.

Further, when the curve of the upper body 12 is formed by the line around the neck and the line extending from the waist position to the sleeve side, and the curve of the lower body 32 is formed to become gradually narrower from the waist position toward the bottom, the finish of the portion around the bottom is made more beautiful and the wearer can enjoy western-style fashion.

Furthermore, when the upper body 12 is formed with no sleeve, a narrow sash is used in the state shown in FIG. 8A, and in addition, high-heeled shoes, mules or boots are matched with the dress as footwear, whereby the wearer can wear the Japanese dress without an uncomfortable feeling at a party in a foreign country while exhibiting the impression of a western-style dress.

When the upper body is formed with the short sleeves 23, the wearer can wear the dress easily without minding the sleeves even when having a meal, and holding and taking care of a child, by winding a narrow sash around the waist in the state shown in FIG. 8B.

Further, when the upper body 12 is formed with the long sleeves 25, the same impression as that of the conventional Japanese dress is given in appearance in the state shown in FIG. 8C, whereby the wearer can wear the Japanese dress with elegance in formal ceremonies such as a wedding ceremony and an entrance and graduation ceremonies.

When out of the upper body 12 and the lower body 32 that are formed as an unlined dress without a lining cloth, the upper body 12 includes the short sleeves 23 and the narrow neckband 27, the wearer can easily move without interference of the sleeves at the time of wearing the dress in the state shown in FIG. 8D. In addition, even though the neckband 27 is attached thereto, the neckband 27 has a narrow width so that the portion around the neck can be made neat. The wearer can wear the Japanese dress casually as an everyday dress at home in a well-balanced manner without a sense of stiffness that is given by the conventional wide neckband.

The invention claimed is:

1. A full-length Japanese dress for covering a body including a bust, an underbust, a waist and hips of a wearer, the dress defining an inner side facing the body and an outer side opposite to the inner side, said dress comprising:

an upper body having an upper front left section and an upper front right section, for covering the body above a waist line of the wearer; and a lower body separate from the upper body and having a lower front left section and a lower front right section, for covering the body below the waist line of the wearer, said lower body three-dimensionally sewn to the upper body of the waist line without interposition of an overlap, wherein the upper body comprises:

a first string having one end portion thereof fixed to the upper front right section, which is located at a position inside from a right side sewing line, and a fourth string having one end portion thereof fixed to the upper front left section, which is located inside a left side sewing line, wherein the lower body comprises:

a second string having one end portion thereof fixed to the lower front left section on the inner side, which is located at a position inside by a length corresponding to a width of a gusset, a third string having one end portion thereof fixed to the lower front right section on the inner side, which is located inside from a right side open end, a fifth string having one end portion thereof fixed to a region which is located inside from the right side open end and is located 11 cm to 13 cm above a middle of the lower body on the inner side in a length direction of the dress, and a sixth string having one end portion thereof fixed to a region which is along an outside of the left side sewing line and is located 16 cm to 18 cm above the middle of the lower body on the inner side in the length direction, and when worn, the third string and the fourth string are tied together to raise a lower front of the dress, the fifth string and the sixth string are tied together at a portion above knees of the wearer to further raise a lower front left hem of the dress, and the first string and the second string are tied together to raise an upper front right hem of the dress, whereby a finish of a portion around a bottom hem of the dress is capable of being fixed.

2. The full-length Japanese dress according to claim 1, wherein in the upper body, a curve line around a neck, and a curve line extending from a waist position to a sleeve side are formed, and in the lower body, a curve line that makes the lower body gradually narrower from the waist position toward the bottom hem is formed.

3. The full-length Japanese dress according to claim 1, wherein the upper body has no sleeve.

4. The full-length Japanese dress according to claim 1, wherein the upper body includes short sleeves.

5. The full-length Japanese dress according to claim 1, wherein the upper body includes long sleeves.

6. The full-length Japanese dress according to claim 1, wherein out of the upper body and the lower body that are formed as an unlined dress without a lining cloth, the upper body includes short sleeves and a neckband.

7. The full-length Japanese dress according to claim 1, wherein the upper body further comprises a lower edge extending horizontally, and the lower body further comprises an upper edge extending horizontally to fix to the lower edge of the upper body.

8. The full-length Japanese dress according to claim 1, wherein the upper body further comprises first arm openings to which arms of the wearer exit when the dress is worn, and sleeve side curve portions formed under each edge of the first arm openings and curving inwardly from each edge of the first arm openings toward the waist line.

9. The full-length Japanese dress according to claim 8, wherein each of the upper front left and right sections comprises a waist side curve portion formed at the waist line.

10. The full-length Japanese dress according to claim 8, wherein the upper body further comprises short sleeves fixed on the upper body, and the short sleeves include second arm openings extending along the first arm openings for the arms of the wearer to exit, and rounded lower end edges formed under each edge of the second arm openings.

11. The full-length Japanese dress according to claim 8, wherein the upper body further comprises long sleeves having a length longer than a length of the upper body in the length direction.

12. A full-length Japanese dress for covering a body including a bust, an underbust, a waist and hips of a wearer, the dress defining an inner side facing the body and an outer side opposite to the inner side, said dress comprising:

an upper body for covering the body above a waist line of the wearer, including an upper front left section, an upper front right section, and an upper back section;

a lower body for covering the body below the waist line of the wearer, formed separately from the upper body and sewn to the upper body at the waist line without interposition of an overlap, said lower body including a lower front left section, a lower front right section, and a lower back section, the upper and lower front left sections sewn together being separated from the upper and lower front right sections sewn together to be able to overlap with each other upon wearing;

a first string fixed to the upper front right section on the outer side of the dress;

a second string fixed to the lower front left section on the inner side of the dress to be tied to the first string to raise an upper front right hem of the dress when worn;

a third string fixed to the lower front right section on the inner side of the dress to be tied to the fourth string to raise a lower front of the dress when worn;

a fourth string fixed to the upper back section on the inner side of the dress, a fifth string fixed below the second and third strings, and 11 cm to 13 cm above a middle of the lower front right section on the inner side of the dress in a length direction of the dress; and a sixth string fixed below the second and third strings, and 16 cm to 18 cm above a middle of the lower front left section on the inner side of the dress in the length direction, said sixth string to be tied to the fifth string at a portion above knees of the wearer to further raise a lower front left hem of the dress when worn.

13. The full-length Japanese dress according to claim 12, wherein the upper back section further comprises:

a right side sewing line defining a right side of the dress and boundary between the upper front right section and the upper back section, and a left side sewing line defining a left side of the dress and boundary between the upper front left section and the upper back section.

14. The full-length Japanese dress according to claim 13, wherein the lower back section further comprises:

a right side sewing line defining a right side of the dress and boundary between the lower front right section and the lower back section, and a left side sewing line defining a left side of the dress and boundary between the lower front left section and the lower back section.

* * * * *